US005125650A

United States Patent [19]

Paris

[11] Patent Number: 5,125,650

[45] Date of Patent: Jun. 30, 1992

[54] FLAT STOMACH MACHINE

[76] Inventor: Erwin W. Paris, Box 3330, Seal Beach, Calif. 90740

[21] Appl. No.: 679,605

[22] Filed: Apr. 3, 1991

[51] Int. Cl.[5] ..... A63B 23/00

[52] U.S. Cl. ..... 482/142; 482/140; 482/907

[58] Field of Search ..... 272/93, 144, 134, 145, 272/105, 136; 297/118, 16, 19, 218-220, 316

[56] References Cited

U.S. PATENT DOCUMENTS 3,043,591 7/1962 Sellner ..... 272/144
4,974,840 12/1990 Welch ..... 272/134

FOREIGN PATENT DOCUMENTS 497883 12/1938 United Kingdom ..... 272/144

*Primary Examiner*—Richard J. Apley
*Assistant Examiner*—Glenn E. Richman
*Attorney, Agent, or Firm*—John E. Halamka

[57] ABSTRACT

An exercise device providing a sling of flexible material forming a cradle supported by a frame so that the cradle is initially taut. The frame is basically a "U" shape fabricated from tube stock. The cradle may be fabricated of canvas with two opposing edges formed as channels into which the frame is inserted. A cross piece completes the closure of the "U" open end, holds the cradle taut and prevents the collapse of the cradle and frame when at upon by the user. The frame by be bent to form a support to hold the cradle in a fixed inclination to the horizontal. A riser and base by be attached to a frame to form a triangle to allow the cradle to be set at a plurality of preselected inclinations.

3 Claims, 2 Drawing Sheets

Fig. 1.
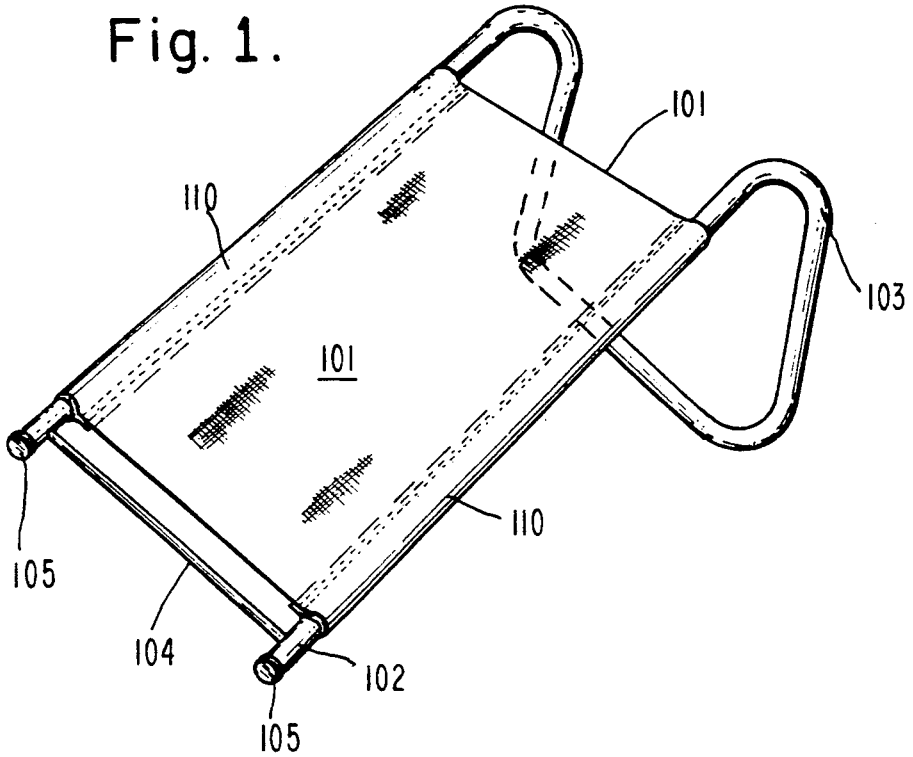
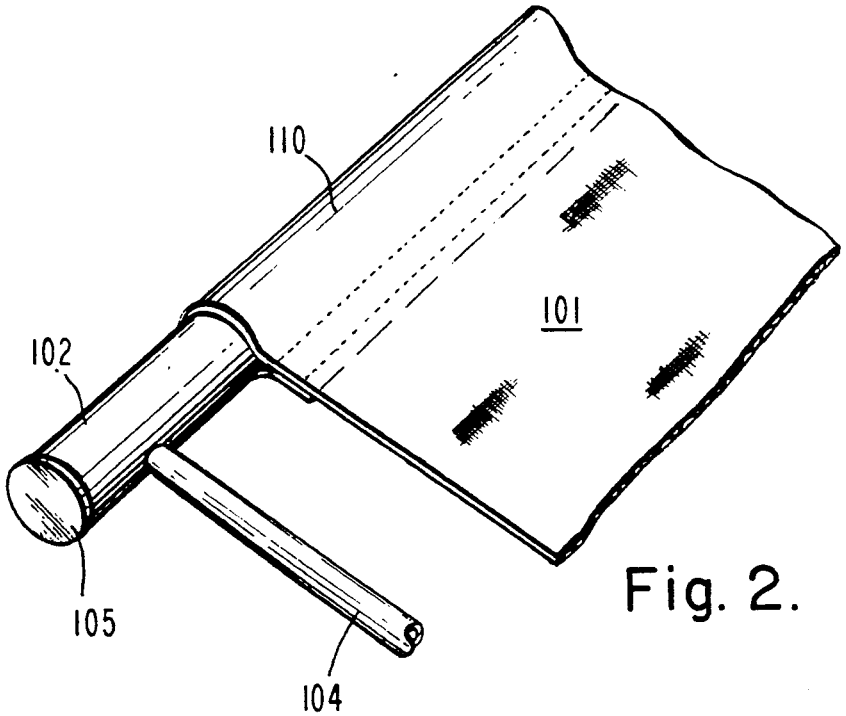
Fig. 2.

Fig. 3.
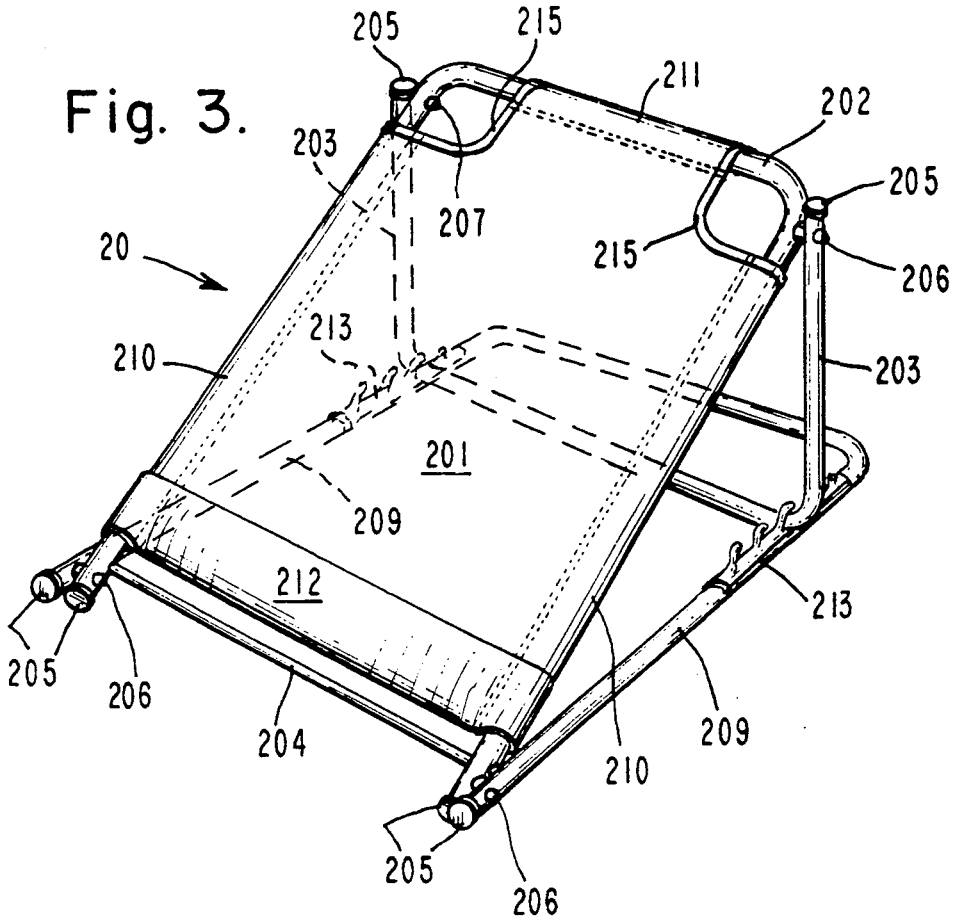
Fig. 4.
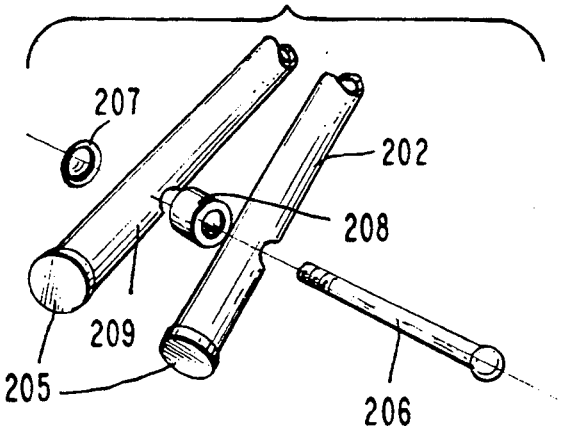
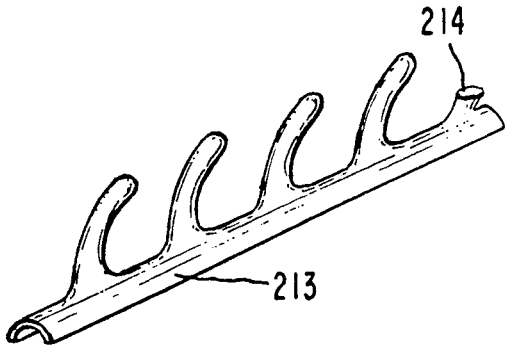
Fig. 5.

FLAT STOMACH MACHINE

BACKGROUND OF THE INVENTION

1. Field of the Invention

This invention relates to the physical health art, and more particularly, to an improved arrangement for effectively exercising selected muscles, including the upper and lower abdominal muscles and the oblique muscles with minimum potential of injury from strains to the muscles being exercised, or damage to other parts of the anatomy such as the back system from compression of the inter vertebral discs of the lumbar vertebrae as well as compression of the surrounding blood vessels and nerves. The invention also provides a superb stretch for the erector spae, the musculature of the lower back.

2. Description of the Prior Art

The modern history of physical exercise evolved from training establishments such as boxing gyms. Innovative persons such as Dr. Win Paris moved the center of exercise from the gyms to clean, open, co-ed fitness centers. The new trend evidenced by the profusion of exercise videos is moving those interested in exercise from the fitness centers to home.

To meet this change, many devices have been developed and are now marketed for home use.

Prior solutions for unsupervised home use of exercise devices which are claimed to be "safe" to use when exercising the abdominal muscles have concentrated on stiff supports which fit the buttocks and curve around the lower back. These devices are unitarily fabricated of rigid plastic. One such device incorporates a series of hand holds in a protrusion along the buttocks. Changing from one hand hold to the next is suppose to increase the resistance the abdominal muscles experience to a "sit up" movement.

However, because the device is rigid, the effect of changing hand holds merely places the arms in a different configuration. Extended the arms does not add significantly to the resistance and can cause strain from over extension of the muscles.

Further, because the device is rigid, it is formed to ergometically fit the "normal" individual. There is no effort expended to size the device to fit the actual user.

The rigid device is suppose to protect the lower back from rubbing and strain while performing sit-ups. However, the starting position is essentially horizontal, and the tail bone rubs against the rigid device instead of the floor. Hence, the device does not solve the problem of reducing the source of injury.

Other devices incorporate an adjustable bench. The incline of the bench surface is used to increase the resistance to sit ups by the user. However, the bench devices are rigid. Even though they may contain padding, the depth of padding is minimal. Such padding is easily crushed flat and adds very little, if any, isolation of the tail bone from the rigid board.

Physiologists have found that repeated rubbing of the tail bone against a rigid surface, compression of the inter vertebral discs of the lumbar region while doing sit ups may cause nerve damage to the spine.

Thus there has long been a need for an arrangement which provides adjustable resistance while providing a non-rigid support surface which conforms to the user and cradles the tail bone during exercises such as sit ups.

It is desired that the contact between the arrangement and the pelvis/spine system be a flexible support.

It is further desired that the support conform to the actual user.

It is also desired that the inclination of the support be adjustable to allow variable resistance to exercises. It is this inclined starting position which is desired to allow for "sit-down" exercise rather than the conventional "sit-up" exercise.

It is further desired that the arrangement be easily folded and stored when not in use.

SUMMARY OF THE INVENTION

Accordingly, it is an object of the present invention to provide an improved arrangement which provides adjustable levels of resistance to "sit-down" exercises performed on the device by the user.

It is another object that the arrangement provide a flexible sling type support which cradles the pelvis/-spine system.

It is yet another object of the invention to provide a non-rigid, conforming support in contact with the tail bone during exercise.

It is yet another object of the invention to provide a small configuration device which is easily stored when not in use.

The above and other objects of the present invention are achieved, according to a preferred embodiment thereof, by providing a flexible, sling means mounted on a widely spaced rigid frame so that a large range of body types may use the arrangement without the pelvis/spine area of the body coming into contact with the rigid frame. The frame may be of a fixed configuration at a preselected inclination of may have means to adjust the angle of inclination to the local horizon.

In the preferred embodiment, a flexible sling is unitarily fabricated of a canvas material. It will be appreciated that other materials may also be utilized to fabricate the sling according to the present invention.

It is preferred that the material utilized be flexible, smooth, a non-irritant to the skin, and non-adhesive to sweaty bare skin. Additionally, further benefits may be provided in selecting certain materials such as resistance to wear and tear, soiling, staining, and comparitively low weight.

In the fixed inclination version, the sling is held taut by the frame.

In the variable inclination version, the unitarily fabricated, flexible sling means has a passage way along each side and a flap on the top edge. The lower edge may be formed as a pocket to contain a pad. The pad provides a stop for the buttocks of the user so that the user can more easily maintain a cradled position in the sling during exercise.

The frame which supports the sling is fabricated of light weight metal tube stock and formed to be insertably into the passage ways of the sling. The top flap of the sling is attached to the frame top cross piece. A lower, small diameter cross piece may be installed to complete the rigid frame to tautly support the sling.

In the fixed inclination version, the "U" shaped frame may be bent at a preselected position to provide a selected inclination angle of the device with the bent portion providing a vertical support to the inclined frame which tautly supports the sling.

In the variable inclination version, an adjustable support may be attached to the frame to allow the user to start exercises at a high inclination angle and to progress to a lower inclination angle during the course of physical development.

This adjustable support may be hingedly attached to the frame to allow the arrangement to be folded essentially flat for storage.

In certain embodiments, the adjustable support is formed as two elements, each hingedly attached to the frame. The upper element is formed as a U shaped riser. The lower element is formed as a U shaped base. A series of catches engagable by the riser are formed or attached to the base to allow the riser to form preselected angles with the base thereby providing selectable angles of inclination of the sling.

BRIEF DESCRIPTION OF THE DRAWINGS

The above and other embodiments of the present invention may be more fully understood from the following detailed description, taken together with the accompanying drawing, wherein similar reference characters refer to similar elements throughout, and in which:

FIG. 1 is a perspective view of an embodiment of the present invention;

FIG. 2 is a detailed perspective view of a portion of the embodiment of FIG. 1;

FIG. 3 is a perspective view of the preferred embodiment;

FIG. 4 is a detailed perspective view of a portion of the embodiment of FIG. 3; and, FIG. 5 is a side view of the catch.

DESCRIPTION OF A PREFERRED EMBODIMENT

Referring now to the drawing, FIG. 1 shows a fixed inclination exercise device 10 fabricated according to the teaching of the this invention.

The device 10 has a frame 102 unitarily fabricated of tube stock in a basic "U" shape with a support 103 formed by bending a selected length of the "U" so that the device 10 has a preselected inclination angle to the horizontal plane.

A sling 101 is fabricated of preselected material such as canvas. The canvas may be dyed an attractive color or may be imprinted with a selected trademark or design.

Each of two opposing edges of the sling 101 are folded over and sewed to form a channel 110 formed with an inside diameter larger that the outside diameter of the frame 102 tube stock. The remaining edges may be folded and sewed to keep the raw edges from raveling.

The legs of the "U" frame 102 are inserted into the pair of channels 110 in the sling 101. The dimensions of the sling 101 and of the frame 102 are selected so that the sling 101 is rather snug when placed on the frame 102.

A cross piece 104 fabricated of a small diameter tube stock or light weight dowel stock is fitted into place near the remote ends of the "U" shaped frame 102.

Now referring to FIG. 2, if a hole with a diameter slightly larger than the outside diameter of the cross piece 104 is drilled only through the "inside" surface of each end portion of the "U" shaped frame 102, the cross piece may be inserted into each hole and will be maintained therein by the tension of the sling 101 on the legs of the "U" shaped frame 102. This cross piece will keep the sling 101 and frame 102 from collapsing inward upon the imposition of the users body in the sling 101.

The channel 110 may be formed by folding over the edge of the sling 101 and double stitching the edge back to the main portion of the sling 101.

A semi-rigid plastic cap 105 may be inserted into the hollow ends of the tube stock of the frame 102 to add to the appearance and prevent injury from the exposed end portion.

FIG. 3 shows an adjustable embodiment 20 of the present invention.

The sling 201 is formed as above with two opposing edges folded over and double stitched to form a pair of channels 210 with an inside diameter slightly larger that the outside diameter of the tube stock selected for the frame 202.

The upper end of the sling 201 between the channels 210 may be formed as a flap 211 which extends over and is secured to the "U" frame 202. The raw edge of the sling 201 cut to form the flap 211 may be protected by a strip of binding 215 secured along the raw edges.

The other end of the sling 201 is folded over onto the main body of the sling 201 to form a pocket 212 at the bottom of the sling 201. This pocket 212 may be filled with a light, resilient padding such as FIBER-FILL to form a slightly raised portion of the sling 201. This slightly raised portion will act as a stop for the buttocks of the user and assist in keeping the user from sliding down the inclined plane of the adjustable embodiment 20. Of course, just the double fold of the edge of the sling 201 will also act as stop as it will not flex as much as the single layer, main body of the sling 201.

In the adjustable embodiment 20, the frame 202 is shaped as a "U" from a preselected tube stock. The legs of the "U" are inserted into the channels 210 of the sling 201. A cross piece 204 is inserted into a hole formed only on the inside surface of the "U" as shown in detail in FIG. 2 for the exercise device 10 above. The length of the cross piece 204 is selected to allow insertion into the frame 202 and keep the sling 201 taut.

The support of the frame 202 is fabricated of two portions, a riser 203 and a base 209. Each portion is hingedly attached to the frame 202. The detail of the attachment is shown in FIG. 4.

Holes are drilled at selected locations in the frame 202, riser 203 and base 209 so that the entire adjustable embodiment 20 may be folded flat for shipping and storage. A pin hinge 206 is inserted from one end through one tube portion, a spacer 208, fabricated of rigid plastic such as teflon for a smooth action, is placed over the pin hinge 206 between the tube sections. The pin hinge 206 is then inserted through the remaining section. A washer 207 is placed over the end of the pin hinge 206 and the exposed end of the pin hinge 206 is crimped over the washer 207 to prevent the pin hinge 206 from being removed.

Now referring to FIG. 3, the riser 203, hingedly attached to the frame 202, is fabricated of tube stock and formed in a "U" shape.

The base 209 is also fabricated of tube stock and formed into a "U" shape. The upper ends of the "U" may be slightly bent (not shown) to allow the base 209 to be hingedly attached to the frame 202 yet lie in a horizontal plane when the arrangement is deployed for exercise use.

A catch 213 is mounted on the upper surface of the base 209. The catch 213 is shown in detail in FIG. 5 as a series of channels, subsequent channels acting as guide and stop for the prior channel. The last channel is complemented with a stop 214. The channels are formed to accept the riser 203 as shown in FIG. 3 to be removably engagable in the third channel.

The length of the riser 203, the base 209 and the position and spacing of the channels in the catch 213 are preselected to allow the inclination of the frame 202 and sling 201 combination to be set at approximately 20°, 25°, 27.5°, and 30°. This establishes four degrees of resistance for the user when exercising on the adjustable embodiment 20. Of course, other angles of inclination and the number of adjustments other than four may be selected.

A semi-rigid cap 205 may be placed into each open end of the frame 202, riser 203 and base 209.

The user may start at the highest inclination angle and progress to the lowest inclination angle. Each stage increases the amount of resistance the body exerts upon the user in performing the exercises.

The exercises are suggested to be as follows: (of course with proper warm-up and cool down stretches)

A: "Shoulder raise"—Place the adjustable device 20 at the beginners level (highest inclination), sit on the sling 201 with the buttocks just above the pad filled edge 212 cradled in the sling away from the frame. Place hands behind the head, and lift shoulders off the sling 201 about 25 degrees breathing out on lift, holding for 2 to 10 seconds and breathing in upon return of the shoulders to the sling 201 surface. B: "Sit-Downs'-'—Select inclination level and sit on sling 201 with the buttocks just above the pad. The trunk of the body is in an approximate vertical position and the legs are extended out, bent at the knee with the feet flat on the floor. Place hands under thighs using the arms to assist in a performance of a sit-down—lower the trunk of the body onto the sling while inhaling, bring the trunk of the body to a vertical position while exhaling.

This exercise may be performed with the hands on the chest or behind the neck to increase the resistance after the basic form is mastered at sufficiently high repetitions (2–30 strength, 30–90 endurance, within 3 minutes).

C: "Trunk twisting"—Perform the shoulder raise as above but when raised above the sling 201 twist the trunk to the right and then to the left to activate the entire oblique musculature while the abdominal muscles are under tension.

D: "Twisting Sit-Down"—Perform the sit-down as above with the hands behind the neck. While in the vertical position, twist the trunk of the body touching the elbow to the opposite knee to activate both abdominal and oblique muscles, complete the movement by performing a sit-down as above.

E: "Oblique curls"—Perform initial set up as for sit-downs above but lay on one side. Place hands behind the head and perform a side curl to contract the oblique muscles, again breathing out on contraction and in on returning to the starting position.

F: "Low back stretch"—Perform initial set up as for sit-downs above but hold your ankles, exhale while bending forward reaching the head as close to the ground as possible to stretch the lower back. Hold the stretch, never jerk or bounce.

Since certain change may be made in the above apparatus without departing from the scope of the invention herein involved, it is intended that all matter contained in the above description, as shown in the accompanying drawing, shall be interpreted in an illustrative, and not a limiting sense.

What is claimed is:

1. An improved arrangement adapted to effectively exercise the upper and lower abdominal and the oblique muscles without compression of the inter vertebral discs of the lumbar vertebrae, surrounding blood vessels and nerves, all within a cradle device providing a plurality of selectable inclinations and comprising, in combination:

a frame, unitarily fabricated of tube stock in a general "U" shape;

a sling, fabricated of preselected flexible, material, having opposite edges folded and secured to form a channel having an inside diameter slightly larger than the outside diameter of said tube stock whereby said frame may be inserted into said channels to provide a tautness to said sling;

a flap formed on one end of said sling between said channels and positioned to be attached to the bottom of said "U" shaped frame whereby said sling is secured to said frame;

a pocket formed by folding the remaining edge of said sling and securing the free edge to the sling;

a cross piece of a selected length mounted to the ends of said "U" shaped frame to aid in establishment of the tautness of said sling and to prevent collapse of said sling and said frame upon the user sitting on said sling;

a riser hingedly mounted in a preselected position of said frame near the bottom of the "U" shape;

a base hingedly mounted in a preselected position of said frame near the top of the "U" shape; and, a catch, forming a preselected number of channels, mounted on said base with said channels removably insertably engagable by said riser to hold said frame at a plurality of preselected inclinations with the horizontal.

2. The arrangement defined in claim 1 further comprising preselected padding material inserted into said pocket.

3. The arrangement defined in claim 1 further comprising a cap inserted into each exposed end of said tube stock.

* * * * *